US006039560A

United States Patent [19]

Kubota

[11] Patent Number: 6,039,560

[45] **Date of Patent: *Mar. 21, 2000**

[54] LOW $NO_X$ BURNER AND METHOD OF CONTROLLING RECIRCULATION OF EXHAUST GAS

[75] Inventor: Norikazu Kubota, Gunma-ken, Japan

[73] Assignee: Sanyo Electric Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,194

[22] Filed: Jan. 30, 1997

[30] Foreign Application Priority Data

Jan. 31, 1996 [JP] Japan ..... 8-035805

[51] Int. Cl.[7] ..... F23M 3/00; F23L 1/00; F23J 11/00; F24H 3/02

[52] U.S. Cl. ..... 431/9; 431/115; 431/116; 110/345; 126/110 R

[58] Field of Search ..... 431/9, 115, 116, 431/12, 10, 4, 8; 126/110 R; 110/345

[56] References Cited

U.S. PATENT DOCUMENTS

| | | | |
|---|---|---|---|
| 3,146,821 | 9/1964 | Wuetig | 431/9 |
| 3,868,211 | 2/1975 | Hay et al. | 431/115 |
| 3,880,570 | 4/1975 | Marshall | 431/115 |
| 3,927,627 | 12/1975 | Brunn | 431/115 |
| 4,023,921 | 5/1977 | Anson | 431/115 |
| 4,204,832 | 5/1980 | Miller | 431/20 |
| 4,362,499 | 12/1982 | Nethery | 431/12 |
| 4,445,843 | 5/1984 | Nutcher | 431/115 |
| 4,644,238 | 2/1987 | Hirosaki | 318/332 |
| 4,645,450 | 2/1987 | West | 431/12 |
| 4,686,437 | 8/1987 | Langley et al. | 318/254 |
| 4,729,207 | 3/1988 | Dempsey et al. | 126/110 R |
| 4,942,832 | 7/1990 | Finke | 431/115 |
| 4,978,896 | 12/1990 | Shah | 318/254 |
| 4,995,807 | 2/1991 | Rampley et al. | 431/9 |
| 5,129,818 | 7/1992 | Balsiger | 431/115 |
| 5,275,554 | 1/1994 | Faulkner | 431/115 |
| 5,284,438 | 2/1994 | McGill | 431/115 |
| 5,331,944 | 7/1994 | Kujawa et al. | 126/110 R |
| 5,347,958 | 9/1994 | Gordon | 431/115 |
| 5,511,971 | 4/1996 | Benz et al. | 431/9 |
| 5,720,231 | 2/1998 | Rowlette et al. | 110/162 |
| 5,736,916 | 4/1998 | Vlahu | 336/69 |

FOREIGN PATENT DOCUMENTS

| | | | |
|---|---|---|---|
| 0071416 | 9/1983 | European Pat. Off. . | |
| 27414 | 1/1990 | Japan . | |
| 1672128 | 8/1991 | Russian Federation | 431/12 |

*Primary Examiner*—Ira S. Lazarus
*Assistant Examiner*—David Lee
*Attorney, Agent, or Firm*—Weingarten, Schurgin, Gagnebin & Hayes LLP

[57] ABSTRACT

A low NOx burner having a burner body, to which an electric fan for supplying air for combustion is connected and which includes an exhaust gas recirculation passage for supplying combustion gas from the burner body to air for combustion, the low NOx burner including an exclusive exhaust-gas recirculation fan provided for the exhaust gas recirculation passage and arranged to forcibly recirculate exhaust gas, and a bypass passage formed between the exhaust gas recirculation passage and a passage for air for combustion formed in the burner body.

11 Claims, 3 Drawing Sheets

LOW $NO_X$ BURNER AND METHOD OF CONTROLLING RECIRCULATION OF EXHAUST GAS

BACKGROUND OF THE INVENTION

1. Field of the Invention

The present invention relates to a low NOx burner and a method of controlling recirculation of exhaust gas, and more particularly to a low NOx burner for use in a combustion apparatus for an absorption type refrigeration machine, a steam boiler, a hot water boiler, a heat cooking machine, a heater and another unit and a method of controlling recirculation of exhaust gas, which is capable of synchronizing with change in the load if the load is changed, stably maintaining the state of combustion and restraining the quantity of generation of NOx.

2. Background Art

Recently, required emission levels of NOx have been regulated severely such that (1) NOx must be 40 ppm ($O_2$=0%) or lower in cold regions, (2) that from gas fuel except 13A must be 60 ppm or lower and (3) that from oil fuel must be 60 ppm or lower.

Hitherto, low NOx burners of a type arranged to be operated by a method of recirculating exhaust gas have been widely used, in which an exhaust gas recirculating duct 7*a* is, as shown in FIG. 3, provided, which has an end connected to a position near an exhaust gas box 8 and another end connected to an air suction passage 9 for an electric fan F to circulate and supply combustion gas so as to lower the temperature of flames of a burner body 1*c* in order to restrict generation of NOx (refer to Japanese Utility-Model Laid-Open No. 2-7414 and so forth). Referring to FIG. 3, reference numeral 2 represents a fuel supply passage, 3 represents a nozzle, 4 represents a passage for supplying air for combustion, 5 represents a burner port, 6 represents a combustion chamber and 10 represents a gas duct.

However, the above-mentioned conventional method structured such that the air suction passage 9 and the exhaust gas box 8 are connected to each other by the exhaust gas recirculating duct 7*a* so as to attract a portion of the combustion gas into the air suction passage 9 through the gas recirculating duct 7*a* has the problems below: the quantity of recirculation can easily considerably be changed attributable to change in the draft pressure in the exhaust gas box 8 and the combustion chamber 10 and the balance between the air supply and gas exhaustion. As a result, the quantity of recirculation of the exhaust gas cannot be controlled to a predetermined quantity, thus resulting in that the combustion state becomes unstable. Moreover, the temperature of the flames of the burner body 1*c* is changed considerably, thus raising a problem in that the quantity of NOx which will be generated becomes unstable. Since the combustion gas, which is recirculated, is introduced into the exhaust gas recirculating duct 7*a* which has been cooled, the combustion gas is condensed on the inner surface of the recirculating duct 7*a*. Thus, there arises a problem in that, for example, the exhaust gas recirculating duct 7*a* is rusted and therefore the durability of the same deteriorates.

SUMMARY OF THE INVENTION

Accordingly, an object of the present invention is to provide a low NOx burner capable of overcoming the above-mentioned problems, reducing the quantity of NOx which will be generated, and causing combustion to be performed stably without generation of rust caused from dew condensation on the surface of an exhaust gas recirculation passage thereof, and a method of controlling recirculation of exhaust gas, which is capable of stably maintaining the state of combustion in synchronization with change in the load even if the load is changed and reducing the quantity of NOx which will be generated.

The inventors of the present invention have performed investigation to solve the above-mentioned problems, thus resulting in that a fact being found that a low NOx burner capable of preventing dew condensation on the surface of the exhaust gas recirculation passage system and generation of rust and exhibiting excellent durability can be provided, which has a structure such that an exclusive exhaust-gas recirculation fan for forcibly recirculating exhaust gas is provided for an exhaust gas recirculation passage; and a bypass passage is formed between the exhaust gas recirculation passage and a passage for air for combustion formed in the burner body so that the quantity of NOx, which will be generated, is reduced and combustion is allowed to take place stably. Moreover, the operation of the exclusive exhaust-gas recirculation fan is interrupted when the operation of the low NOx burner is started so that fresh air in the passage for air for combustion is, in a small quantity, allowed to flow backward to the exhaust gas recirculation passage through the bypass passage. After the temperature of the exhaust gas has been raised and dew condensation in the gas duct system has disappeared, the exclusive exhaust-gas recirculation fan is operated. In addition, a method of controlling recirculation of exhaust gas is provided in which the revolution speed of the exclusive exhaust-gas recirculation fan is changed by an inverter in synchronization with a load signal to make the ratio of exhaust gas which will be recirculated to be constant so that the quantity of NOx, which will be generated, is reduced and thus the combustion is allowed to furthermore stably be performed.

According to one aspect of the present invention, there is provided a low NOx burner, as claimed in claim 1, having a burner body, to which an electric fan for supplying air for combustion is connected and which includes an exhaust gas recirculation passage for supplying combustion gas from the burner body to air for combustion, the low NOx burner comprising: an exclusive exhaust-gas recirculation fan provided for the exhaust gas recirculation passage and arranged to forcibly recirculate exhaust gas; and a bypass passage formed between the exhaust gas recirculation passage and a passage for air for combustion formed in the burner body.

Another aspect of the present invention according to claim 1 is, as claimed in claim 2, structured such that the operation of the exclusive exhaust-gas recirculation fan is interrupted when the operation of the low NOx burner is started so that fresh air in the passage for air for combustion is, in a small quantity, allowed to flow backward to the exhaust gas recirculation passage through the bypass passage.

According to another aspect of the present invention, there is, as claimed in claim 3, provided a method of controlling recirculation of exhaust gas comprising the step of: changing the revolution speed of the exclusive exhaust-gas recirculation fan of the low NOx burner according to claim 1 or 2 by an inverter in synchronization with a load signal (a combustion quantity control signal) so that control is performed such that the ratio of recirculation of exhaust gas is made to be constant.

Another aspect of the present invention according to claim 3 is, as claimed in claim 4, structured such that the level of NOx contained in the exhaust gas is detected so as to correct the revolution speed of the exclusive exhaust-gas recirculation fan.

Another aspect of the present invention according to claim 3 is, as claimed in claim 5, structured such that the quantity of exhaust gas which is recirculated is detected so as to correct the revolution speed of the exclusive exhaust-gas recirculation fan.

Another aspect of the present invention according to any one of claims 3 to 5 is, as claimed in claim 6, structured such that a frequency higher than the commercial frequency is used in the control operation and the revolution speed of the exclusive exhaust-gas recirculation fan is made to be high speed so that the size of the exclusive exhaust-gas recirculation fan is reduced.

Other objects, features and advantages of the invention will be evident from the following detailed description of the preferred embodiments described in conjunction with the attached drawings.

DETAILED DESCRIPTION OF THE PREFERRED EMBODIMENTS

Figure 1:
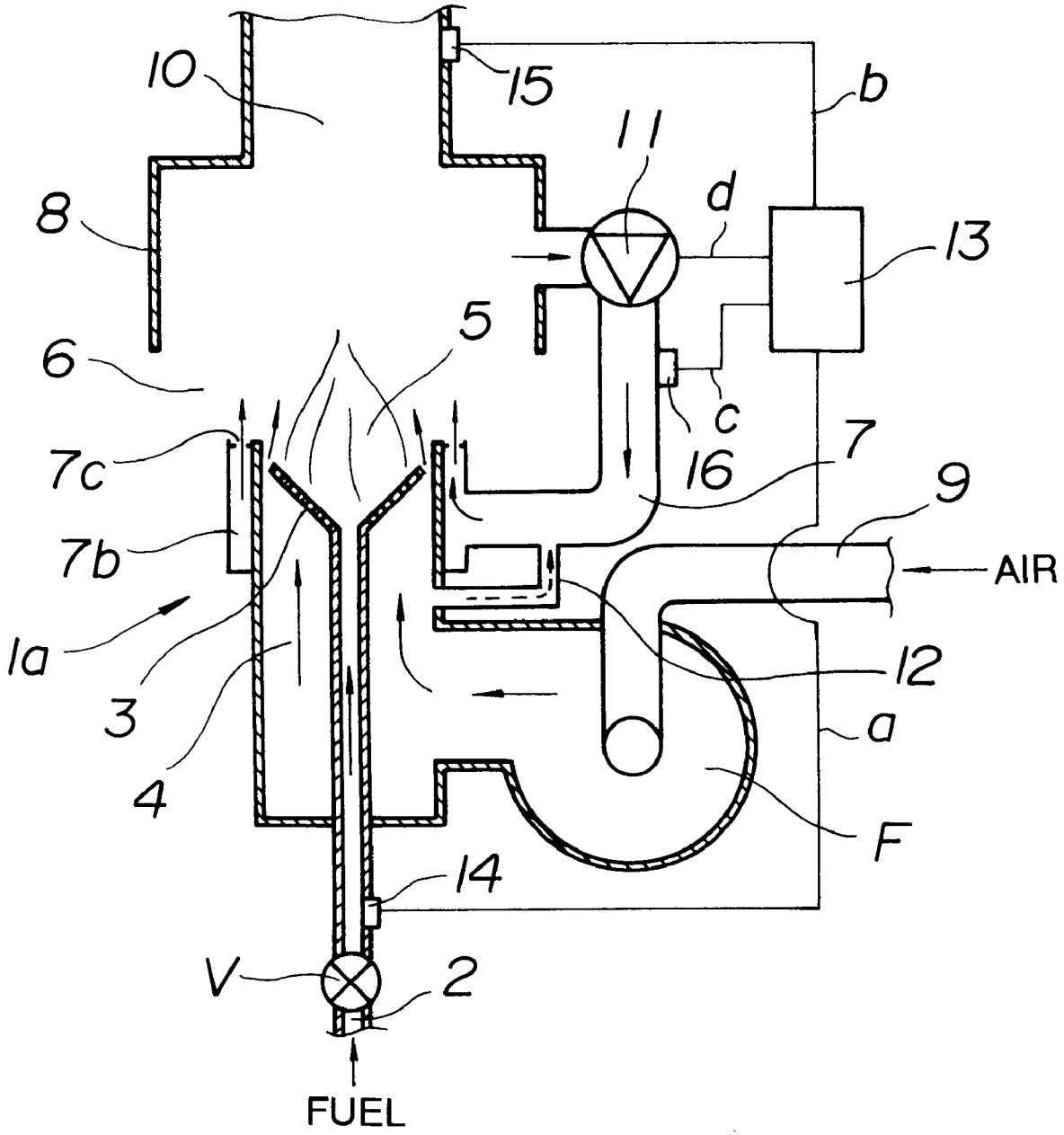
FIG. 1 is a diagram showing an example of a low NOx burner and a method of controlling recirculation of exhaust gas according to the present invention.
Figure 2:
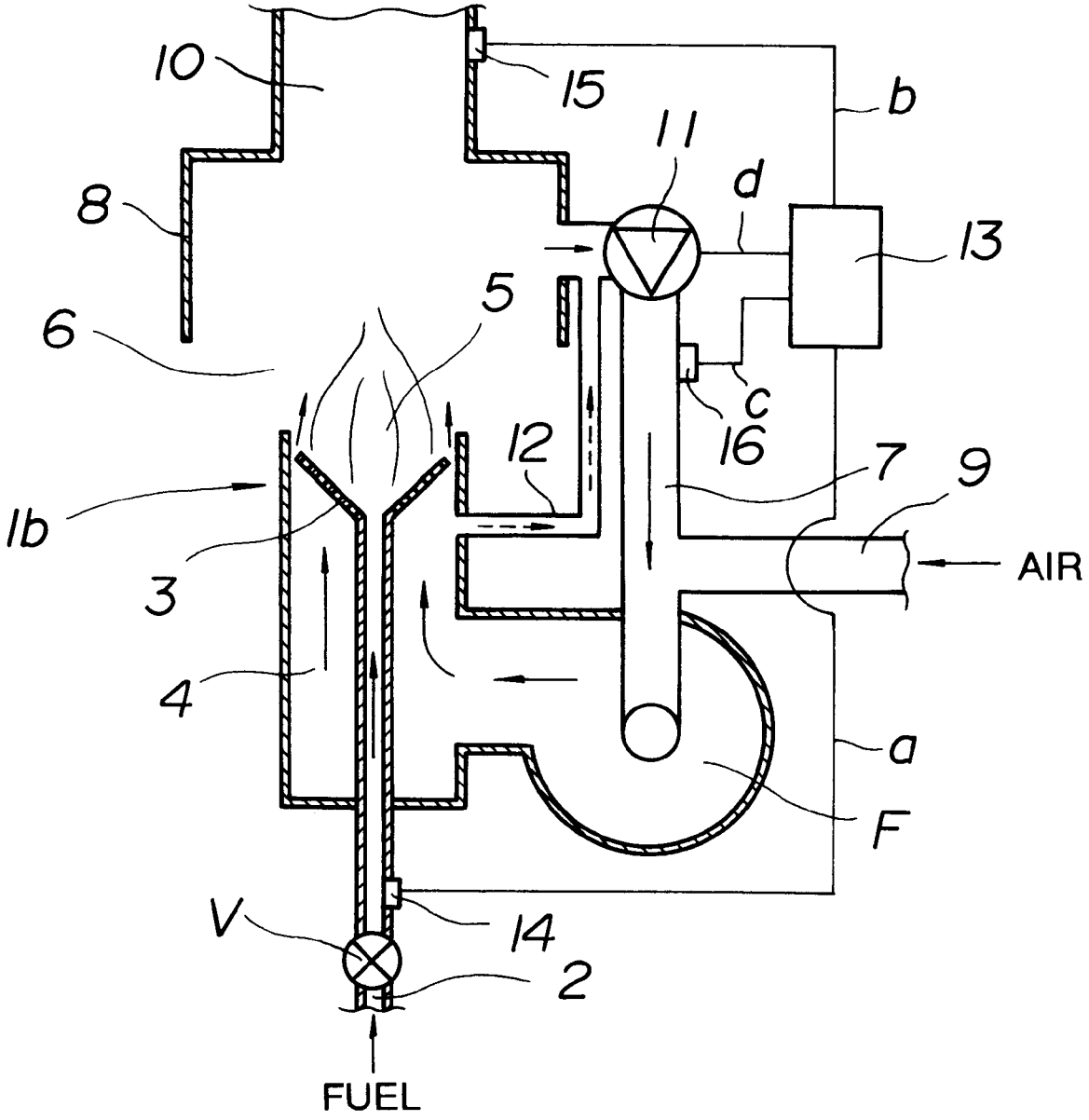
FIG. 2 is a diagram showing another example of the low NOx burner and the method of controlling recirculation of exhaust gas according to the present invention.
Figure 3:
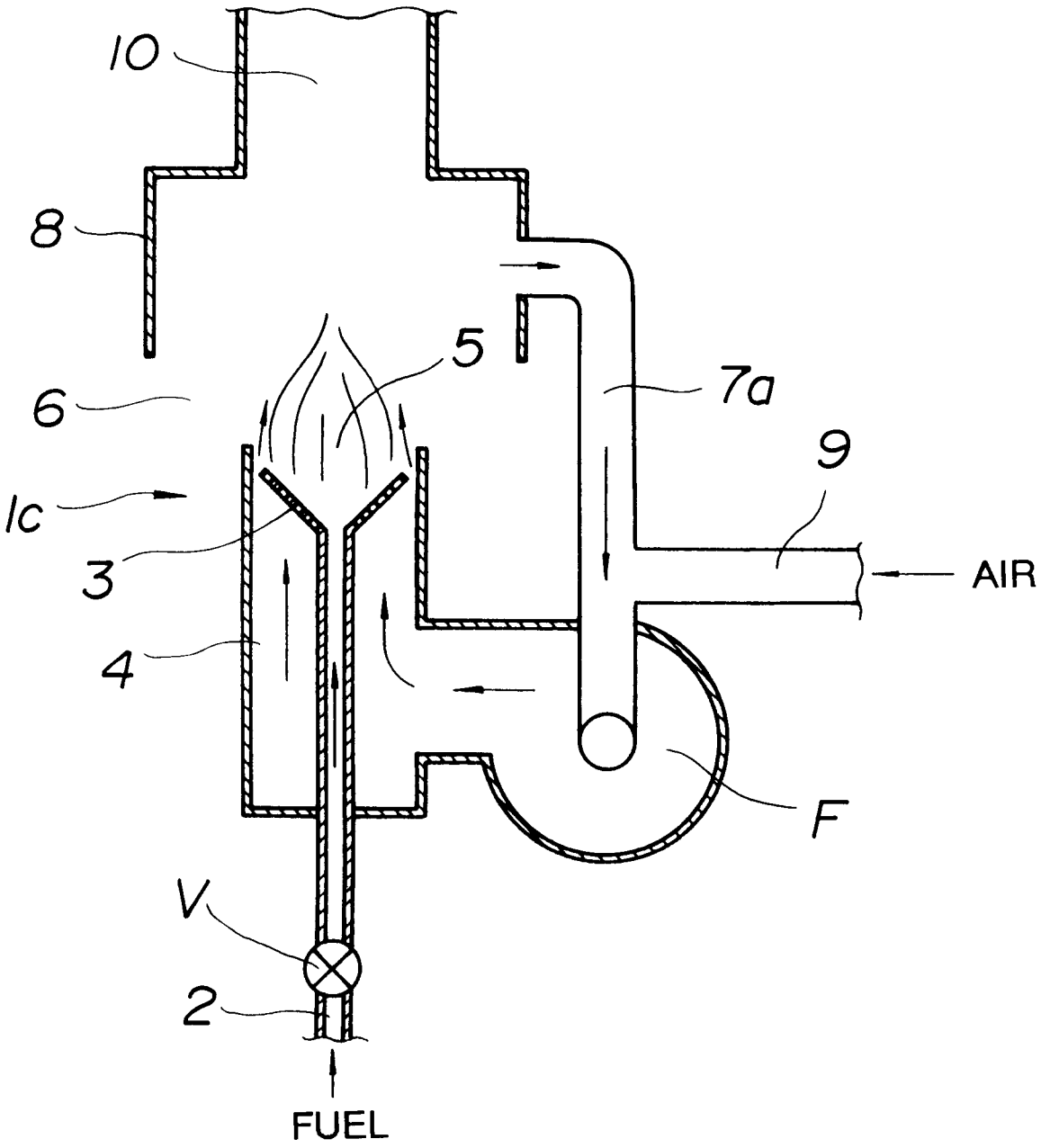
Fig.3 Prior Art
FIG. 3 is a diagram showing a conventional low NOx burner adapted to a conventional exhaust gas recirculation method.

FIG. 1 is a diagram showing an embodiment of a low NOx burner and a method of controlling recirculation of exhaust gas according to the present invention. FIG. 2 is a diagram showing another embodiment of the low NOx burner and the method of controlling recirculation of exhaust gas according to the present invention.

Referring to FIG. 1, a burner body 1*a* having an electric fan F for supplying air for combustion connected thereto includes a nozzle 3 connected to a fuel supply passage 2 having a flow adjustment valve V. Moreover, a passage 4 for supplying air for combustion is, in the burner body 1*a*, formed from the electric fan F to the nozzle 3. Thus, mixed gas of air and fuel can be blown into a combustion chamber 6 through a burner port 5.

An end of an exhaust gas recirculation passage 7 for supplying combustion gas from the burner body 1*a* to air for combustion is connected to an exhaust gas recirculation box 7*b* disposed adjacent to the outer surface of the leading end of the nozzle 3 and having an outlet port 7*c* from which recirculated exhaust gas is blown out. Another end of the exhaust gas recirculation passage 7 is connected to an exhaust-gas box 8 into which exhaust gas is introduced from the burner body 1*a*. The exhaust gas recirculation passage 7 has, in the portion thereof adjacent to the exhaust-gas box 8, an exclusive exhaust-gas recirculation fan 11 for forcibly recirculating exhaust gas. Moreover, a portion of the exhaust gas recirculation passage 7 adjacent to the exhaust gas recirculation box 7*b* is provided with a bypass passage 12 for establishing the connection between the passage 4 for supplying air for combustion and the exhaust gas recirculation passage 7. Reference numeral 9 represents an air suction passage 9, and 10 represents a gas duct 10 allowed to communicated with the exhaust-gas box 8.

The low NOx burner 1*a* according to the present invention having the above-mentioned structure to control the revolution speed of the exclusive exhaust-gas recirculation fan 11 is able to control the quantity of exhaust gas which is forcibly recirculated to a predetermined quantity. Therefore, the flow of air for combustion can stably be controlled to a quantity sufficient to cause perfect combustion to be performed. As a result, the state of combustion can be stabilized such that the temperature of flames of the burner body 1*a* is not changed considerably. Thus, the temperature can stably be controlled to a level at which NOx can satisfactorily be reduced. Therefore, the quantity of NOx which will be generated can be reduced.

When the operation is started, the exclusive exhaust-gas recirculation fan 11 is turned off so that fresh air for combustion in the passage 4 for supplying air for combustion is, as indicated by a dashed line shown in FIG. 1, allowed to flow backward to the overall body of the exhaust gas recirculation passage 7 in a small quantity through the bypass passage 12. After the temperature of the exhaust gas has been therefore raised and dew condensation in the gas duct has disappeared, the exclusive exhaust-gas recirculation fan 11 is started. As a result, dew condensation on the inner surface of the exhaust gas recirculation passage 7 can be prevented. Consequently, the problem of generation of rust and deterioration in the durability can be solved.

Reference numeral 13 represents a control unit. The control unit 13 is, through circuits a, b and c, connected to a fuel flow meter 14 disposed at an intermediate position of the fuel supply passage 2, a NOx sensor 15 for detecting NOx contained in the combustion gas in the gas duct 10 and a flow meter 16 for detecting the quantity of the exhaust gas which is recirculated through the exhaust gas recirculation passage 7.

In the low NOx burner 1*a* according to the present invention, when a load signal (a fuel quantity control signal) has been supplied to the control unit 13 from the control valve V or the fuel flow meter 14 through the circuit a, a signal is supplied from the control unit 13 to the exclusive exhaust-gas recirculation fan 11 through a circuit d in response to the supplied signal. Thus, the revolution speed of the exclusive exhaust-gas recirculation fan 11 is changed by an inverter so that the exhaust gas recirculation ratio is made to be constant. As a result of the method of controlling recirculation of exhaust gas according to the present invention, the state of combustion can stably be maintained in synchronization with change in the load even if the load is changed. Thus, the quantity of NOx which will be generated can be reduced.

The level of NOx contained in the exhaust gas is detected by the NOx sensor 15, a signal supplied from the NOx sensor 15 is, via the circuit b, supplied to the control unit 13, and the revolution speed of the exclusive exhaust-gas recirculation fan 11 is therefore corrected. Thus, the state of combustion can be maintained stably and the quantity of NOx which will be generated can be reduced more reliably and stably.

The quantity of exhaust gas which is recirculated is detected by the flow meter 16 for detecting the quantity of the exhaust gas which is recirculated through the exhaust gas recirculation passage 7, a signal supplied from the flow meter 16 is transmitted to the control unit 13 through the circuit c and the revolution speed of the exclusive exhaust-gas recirculation fan 11 is corrected. As a result, the state of combustion can be maintained furthermore stably and thus the quantity of NOx which will be generated can furthermore stably be reduced.

In this embodiment, the above-mentioned control is performed with a frequency which is higher than the commercial frequency. Moreover, the revolution speed of the exclusive exhaust-gas recirculation fan 11 is determined to be high speed. Thus, the size of the exclusive exhaust-gas recirculation fan 11 can be reduced. Specifically, the frequency is, for example, 90 Hz or lower, preferably 80 Hz or lower. If the frequency is higher than 90 Hz, the balance of the exclusive exhaust-gas recirculation fan 11 deteriorates, thus raising a problem of strength and noise.

FIG. 2 shows another embodiment of the low NOx burner and the method of controlling recirculation of exhaust gas according to the present invention. Referring to FIG. 2, the same reference numerals and symbols as those shown in FIG. 1 represent the same elements, The burner body 1*b* having the electric fan F for supplying air for combustion connected thereto is structured such that an end of an exhaust gas recirculation passage 7 for supplying combustion gas from the burner body 1*b* to air for combustion is connected to the air suction passage 9 for the electric fan F connected to the burner body 1*b*. On the other hand, another end of the exhaust gas recirculation passage 7 is connected to the exhaust-gas box 8. The exhaust gas recirculation passage 7 has, in the portion thereof adjacent to the exhaust-gas box 8, an exclusive exhaust-gas recirculation fan 11 for forcibly recirculating exhaust gas. Moreover, the bypass passage 12 is provided which has an end connected to the exhaust gas recirculation passage 7 for connecting the exhaust-gas box 8 and the 11 to each other and another end connected to the passage 4 for supplying air for combustion in the burner body 1*b*.

Similarly to the burner body 1*a*, the low NOx burner 1*b* according to the present invention having the above-mentioned structure to control the revolution speed of the exclusive exhaust-gas recirculation fan 11 is able to control the quantity of exhaust gas which is forcibly recirculated to a predetermined quantity. Therefore, the flow of air for combustion can stably be controlled to a quantity sufficient to cause perfect combustion to be performed. As a result, the state of combustion can be stabilized such that the temperature of flames of the burner body 1*b* is not changed considerably. Thus, the temperature can stably be controlled to a level at which NOx can satisfactorily be reduced. Therefore, the quantity of NOx which will be generated can be reduced.

When the operation is started, the exclusive exhaust-gas recirculation fan 11 is turned off so that fresh air for combustion in the passage 4 for supplying air for combustion is, as indicated by a dashed line shown in FIG. 2, allowed to flow backward to the overall body of the exhaust gas recirculation passage 7 in a small quantity through the bypass passage 12. After the temperature of the exhaust gas has been therefore raised and dew condensation in the gas duct has disappeared, the exclusive exhaust-gas recirculation fan 11 is started. As a result, dew condensation on the inner surface of the exhaust gas recirculation passage 7 can be prevented. Consequently, the problem of generation of rust and deterioration in the durability can be solved.

The method of controlling recirculation of exhaust gas adapted to the low NOx burner 1*b* according to this embodiment is the same as that for the above-mentioned burner body 1*a*. Similarly to the burner body 1*a*, the state of combustion can stably be maintained and thus the quantity of NOx which will be generated can be reduced.

The structure of each of the low NOx burners 1*a* and 1*b* may be varied arbitrarily and may be a gas burner or an oil burner. An adequate air and fuel mixing structure may be employed to be adaptable to fuel and the combustion method employed.

The electric fan F may be provided individually from the burner body 1*a* or 1*b* such that the electric fan F is connected to the burner body 1*a* or 1*b* with an external pipe line.

The subject, which is heated by the low NOx burner according to the present invention, may arbitrarily be selected. The present invention may be applied to, for example, a combustion apparatus for an absorption type refrigeration machine, a steam boiler, a hot water boiler, a heat cooking machine, a heater and another unit.

As described above, the low NOx burner according to the present invention is not affected by the draft pressure in the gas duct and capable of controlling the quantity of exhaust gas which is recirculated to a constant value. Therefore, rise in the NOx level can be prevented. That is, the quantity of NOx, which will be generated, can be reduced and thus combustion can be allowed to take place stably. When the operation is started, fresh air (air for combustion) is allowed to flow backward to the bypass passage. After the temperature of the exhaust gas has been raised and dew condensation in the gas duct system has disappeared, the exclusive exhaust-gas recirculation fan is operated. Thus, dew condensation in the exhaust gas recirculation system can be prevented, and thus the durability can be improved. The low NOx burner according to the present invention has a simple structure and exhibits a low cost, satisfactorily performance and excellent economical advantage.

The method of controlling recirculation of exhaust gas according to the present invention structured such that the revolution speed of the exclusive exhaust-gas recirculation fan is changed by the inverter in synchronization with the load signal enables the state of combustion to be maintained stably in synchronization with change in the load even if the load is changed. Thus, the quantity of NOx, which will be generated, can be reduced.

The NOx sensor for detecting the level of NOx contained in exhaust gas and the flow rate meter for detecting the quantity of exhaust gas which is recirculated through the exhaust gas recirculation passage are provided, and the signals from the sensors are supplied to the control unit so as to correct the revolution speed of the exclusive exhaust-gas recirculation fan. Thus, the state of combustion can furthermore stably be maintained, and the quantity of NOx, which will be generated, can furthermore stably be reduced.

The frequency for use in the control operation is made to be 90 Hz or lower and the revolution speed of the exclusive exhaust-gas recirculation fan is determined to high speed so that the size of the exclusive exhaust-gas recirculation fan is reduced.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A low $NO_x$ burner comprising:

a burner body comprising a combustion chamber, a nozzle that opens into a burner port that in turn opens into said combustion chamber, a fuel supply passage connected to the nozzle, a blower for supplying air for combustion, an air suction passage extending from an air source to said blower, and an air supply passage for supplying air for combustion that extends from the blower to the nozzle and surrounds the nozzle;

an exhaust-gas chamber into which combustion exhaust gas is introduced from said burner body;

an exhaust-gas duct connected to said exhaust-gas chamber, for conducting exhaust gas to an outlet;

an exhaust-gas recirculation passage for supplying combustion exhaust gas from said burner to said air supply passage, the exhaust-gas recirculation passage having an inlet connected to said exhaust-gas chamber and an outlet connected to said air suction passage;

an exhaust-gas recirculation fan provided within said exhaust-gas recirculation passage, to forcibly recirculate exhaust gas from said exhaust-gas chamber to said air supply passage;

a bypass passage formed between said exhaust-gas recirculation passage and said air supply passage, one end of said bypass passage connecting to said exhaust-gas recirculation passage upstream of said exclusive exhaust-gas recirculation fan;

a fuel flow meter and a fuel flow adjustment valve in said fuel supply passage;

a $NO_x$ sensor in said exhaust-gas duct;

a flow rate meter in said exhaust-gas recirculation passage, for detecting the quantity of exhaust gas recirculated; and a control unit for controlling said exhaust gas recirculation fan.

2. The burner of claim 1, wherein said control unit is adapted to receive a signal from said fuel flow meter or said fuel flow adjustment valve, a signal from said $NO_x$ sensor, and a signal from said flow rate meter, said control unit operating in response to at least one of said signals to correct the revolution speed of said exhaust-gas recirculation fan.

3. A method of controlling recirculation of exhaust gas comprising the step of:

changing a revolution speed of an exhaust-gas recirculation fan of a low $NO_x$ burner according to claim 1 by an inverter in synchronization with a load signal comprising a combustion quantity control signal, to control the quantity of exhaust gas that is recirculated to a predetermined quantity.

4. A method of controlling recirculation of exhaust gas according to claim 3, wherein the level of NOx contained in the exhaust gas is detected so as to correct the revolution speed of said exhaust-gas recirculation fan.

5. A method of controlling recirculation of exhaust gas according to claim 3, wherein the quantity of exhaust gas which is recirculated is detected so as to correct the revolution speed of said exhaust-gas recirculation fan.

6. A method of controlling recirculation of exhaust gas according to claim 3, wherein said control unit operates at a frequency of about 90 Hz or less, and the revolution speed of said exhaust-gas recirculation fan is made to be high speed so that the size of the exhaust-gas recirculation fan is reduced.

7. A method of controlling recirculation of exhaust gas according to claim 3, wherein the operation of said exhaust-gas recirculation fan is interrupted when the operation of said low $NO_x$ burner is started so that fresh air from said air supply passage is, in a small quantity, allowed to flow backward to said exhaust-gas recirculation passage through said bypass passage.

8. A method of controlling recirculation of exhaust gas according to claim 7, wherein the quantity of exhaust gas which is recirculated is detected so as to correct the revolution speed of said exhaust-gas recirculation fan.

9. A method of controlling recirculation of exhaust gas according to claim 4, wherein the quantity of exhaust gas which is recirculated is detected so as to correct the revolution speed of said exclusive exhaust-gas recirculation fan.

10. A method of controlling recirculation of exhaust gas according to claim 7, wherein said control unit operates at a frequency of about 90 Hz or less, and the revolution speed of said exhaust-gas recirculation fan is made to be high speed so that the size of the exhaust-gas recirculation fan is reduced.

11. A method of controlling recirculation of exhaust gas according to claim 9, wherein said control unit operates at a frequency of about 90 Hz or less, and the revolution speed of said exhaust-gas recirculation fan is made to be high speed so that the size of said exhaust-gas recirculation fan is reduced.

* * * * *